US005171436A

United States Patent [19]

Botsch

[11] Patent Number: 5,171,436

[45] Date of Patent: Dec. 15, 1992

[54] APPARATUS FOR THE CONVEYANCE OF SCREENING

[76] Inventor: Bertram Botsch, Albtalstrassel 3, 7500 Karlsruhel, Fed. Rep. of Germany

[21] Appl. No.: 426,224

[22] Filed: Oct. 25, 1989

[30] Foreign Application Priority Data

Oct. 31, 1988 [DE] Fed. Rep. of Germany ..... 3836983
Oct. 6, 1989 [DE] Fed. Rep. of Germany ..... 3933462

[51] Int. Cl.[5] ..... B01D 29/64

[52] U.S. Cl. ..... 210/159; 210/162; 210/357; 210/413

[58] Field of Search ..... 210/159, 162, 357, 413, 210/298, 407, 415, 527, 531

[56] References Cited

U.S. PATENT DOCUMENTS

| | | | |
|---|---|---|---|
| 710,804 | 10/1902 | Riel | 210/162 |
| 1,180,798 | 4/1916 | Spoon | 210/162 |
| 2,684,157 | 7/1954 | Tolman | 210/159 |
| 2,696,308 | 12/1954 | Martin | 210/159 |
| 3,018,893 | 1/1962 | Collie et al. | 210/159 |
| 3,144,406 | 8/1964 | Crise | 210/159 |
| 4,329,230 | 5/1982 | Quin | 210/413 |
| 4,709,804 | 12/1987 | Duperon | 210/413 |

*Primary Examiner*—James C. Housel
*Attorney, Agent, or Firm*—Wenderoth, Lind & Ponack

[57] ABSTRACT

An apparatus conveys screenings collected on a bar screen partially immersed in a sewage flow and inclined in the flow direction, and in certain cases on an adjoining apron screen. A rake device conducts the screenings to a discharge position at the upper edge of the bar screen or the apron screen. The screenings are conveyed simultaneously along at least two conveying paths and thus given screenings are transferred along mutually adjoining conveying paths. The rake device includes at least two rake members spaced at intervals in the conveying direction and connected together by a common drive that causes simultaneous translatory movements in the same direction of both rake members.

17 Claims, 2 Drawing Sheets

APPARATUS FOR THE CONVEYANCE OF SCREENING

BACKGROUND OF THE INVENTION

The invention relates to an apparatus for the conveyance of collected debris or screenings on a bar screen partially immersed in a sewage flow and inclined in the direction of flow, in certain cases with an adjoining apron screen, to a discharge position situated at an upper edge of the bar screen or the apron screen, with the aid of a rake device periodically movable between the bars of the bar screen, by means of which the screenings are heaped together periodically along a conveyance path.

Such an apparatus serves for the removal and conveyance from the sewage of screenings adhering to the bar screen by being guided periodically along a conveying path from the bottom upwardly by a rake device. The overall length of the conveying path is determined by the length of the bar screen and by the length of the adjoining apron screen, wherein applicable.

In a known rake device according to DE-PS 16 58 096 (corresponding to U.S. Pat. No. 3,591,006) the drive period of the rake determined by the length of the conveying path and the speed of conveyance. Since the speed of conveyance cannot be increased beyond a given value, the drive period becomes very great particularly with long conveying paths. This leads to an increase in the amount of screenings which become collected on the bar screen within the drive period and which have to be conveyed.

Excessively large quantities of screenings collected on the bar screen can partly block the latter, so that the necessary hydraulic flow no longer is guaranteed. At maximum hydraulic load maximum quantities of screenings also frequently occur, and blocking of the bar screen by screenings can cause critical operating conditions. Moreover, unblocking of the bar screen, and where applicable the adjoining apron screen, in a single movement of the rake device requires considerable structural outlay with respect to the rake operating mechanism and necessitates a free extension height above the discharge position. This can be achieved only with a corresponding increase in height of the building or structure housing the screen and hence by an uneconomical site expenditure.

SUMMARY OF THE INVENTION

The object of the invention is to provide an apparatus to solve the above problem, where a rake device of the kind described above is used, but whereby it is possible to reduce substantially the length of time of the drive or conveyance movement.

This object is achieved in accordance with the invention by providing that the collected debris or screenings are conveyed simultaneously along at least two conveying paths due to consecutive transfer from mutually adjoining conveying paths. The mutually adjoining conveying paths with advantage also can overlap slightly in certain cases. An apparatus according to the invention is composed in such a way that there are provided at least two rake members located at intervals in the conveying direction and connected to each other by a common drive assembly that simultaneously imports to the rake members translatory movements in the same direction. The screenings are thereby conveyed simultaneously during one drive period only over relatively short conveying paths along the bar screen or apron screen, and rake members coupled to each other convey the screenings further from such preceding conveying path during another drive period.

Such an arrangement not only produces a substantial reduction in the drive period and hence the length of &:he conveying path of the rake member, but also provides additional advantages. Within the shorter drive period a correspondingly smaller amount of screenings need be conveyed, with an overall equal incidence of screenings along each conveying path. This makes possible a lower drive power of the drive unit of the rake device. The necessary clearance motion is reduced according over the length of the individual conveying sections. It is therefore unnecessary to provide in the region of the upper discharge position point a large unobstructed clearance of the extension of the rake device. In the case of the drive elements being located above the discharge position, the overall height of the structure is reduced in proportion to the correspondingly shortened lengths of the shortened clearance motion.

Because the overall length of conveying is composed of relatively short conveying path sections, the overall distance of movement of the rake device becomes substantially smaller, so that loose cables are possible for supplying energy to the drive elements. This is particularly advantageous with the crude operating conditions existing in sewage treatment plants. In addition, a lengthening or shortening of the conveying path by multiple use of standardized components corresponding to a single conveying section length is possible. Depending on the overall conveying length in each particular case, such components can then form part of a longer or shorter load-bearing element which is connected to a common drive unit.

The rake members are with advantage spaced at equal intervals in the conveying direction, and it is advisable for the distance between the rake members to be less than the respective value of of the water depth projected onto the inclined bar screen.

A further advantage can be achieved in certain cases by the bar screen and/or the apron being of staged design and comprising at least one deposition stage in such a way that the screenings are deposited by one rake member onto such deposition stage and then is collected therefrom by the next rake member for further conveyance.

Although various structural designs are possible, it seems advisable to position the rake members connected by rake arms as load-bearing elements in a lateral connecting link guide in order to control the engagement movement and to design the drive of the connected rake members as a common movement along an enclosed track comprising at least one section of track running parallel to the bar screen or apron screen. As a further development of the invention, it may be advisable for reversing guide parts to be provided at adjacent ends of the enclosed track for transition from one linear track section to another linear track section.

The inclination of the bar screen relative to the perpendicular, considered in the flow direction, is advisably 10°-50°, preferably 15°-30°. The invention possesses particular importance for the unblocking of stationary bar screens.

It can also be advisable to fix the distance between at least two adjacent rake members as 15–45% of the raked length of the bar screen. Surprisingly, the screenings remain sticking to individual sections of an immersed bar screen even after its being unblocked in sections.

An additional advantage may be achieved by additional screen bars also being attached to the surface of the intrinsically planar apron screen. The adhesion of the screenings can thereby be improved.

The bars of the bar screen and/or the adjacent apron screen can with advantage be designed to overlap. Deposition stages are thereby created at the regions of slightly overlapping adjacent sections of the conveying paths.

It may also be advantageous, preferably in the end regions of the conveying paths of the rake members, to provide rakeable support elements which prevent downward sliding of the screenings already conveyed. These rakeable support elements can be designed in various ways, depending on whether they lie in the region of the bar screen or in the adjoining region of the apron screen. The rakeable support elements can with advantage be swivellable retaining flaps extending over at least a part of the conveying path and pressed into extended positions by springs. The width of the retaining flaps can with advantage equal the entire conveying width. The retaining flaps in addition can include a circular attachment connected to a support member. Another arrangement, suitable in certain circumstances for the region of the bar screen, can provide between the bars of the screen swivelling fingers which are pressed into extended positions by springs. These rakeable support elements provide a substantial safeguard against sliding down of already conveyed screenings.

Although the rake members on the common load-bearing element are mostly arranged to be inclined in the conveying direction, it has been shown by tests that in certain circumstances an improvement can be achieved with particular angular positions of the bar screen if the rake members are arranged on the common load-bearing element to be inclined away from the conveying direction.

The shapes of the rake members connected to each other and provided with a common drive assembly naturally also can differ according to the requirements of the conveying section service thereby. For example, whereas the rake members engaging between the bars of the bar screen can take the form of fingers lying adjacent to one another, it seems advisable to design the rake members that move above the bar screen on the apron screen as linear scraping edges or similar structures.

Through the features of the invention, and in particular through the sub-division of the entire conveying path of the screenings into several consecutive sections, a substantially improved overall structural lay-out is achieved, which can easily be adapted to the most varied technical plant requirements.

BRIEF DESCRIPTION OF THE DRAWINGS

Embodiments of the invention will be explained with reference to the accompanying drawings, wherein.

DETAILED DESCRIPTION OF THE INVENTION

Figure 1:
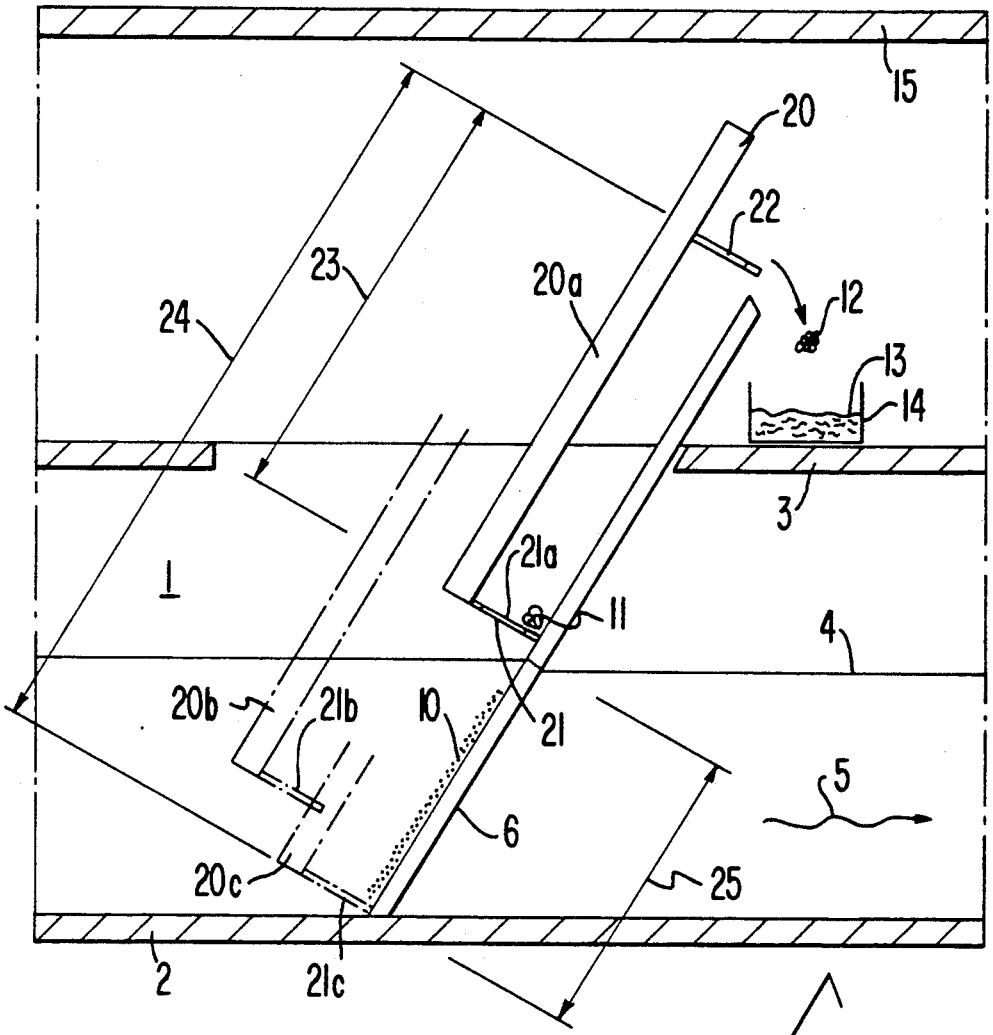
FIG. 1 is a diagrammatic longitudinal section through a conveying device of two-stage design.

FIG. 1 shows the typical lay-out of a screening plant using the device for the conveyance of collected debris or screenings according to the invention. A sewage flow 5 flows in a channel 1. Between a channel floor 2 and an upper operation floor 3 is located a bar screen 6 which projects beyond the operation floor 3 and whose upper edge forms the discharge position. Screenings 10 contained in the sewage flow are deposited on the bar screen 6 and are conveyed by the conveying device to the discharge position. The screenings then pass over the discharge position as discharged portions 12 into a container 14 and form an intermediately-stored screenings stock 13 which can be removed.

The conveying device includes a load-bearing element 20 connected to a drive assembly (not shown) and to which are attached two rake members 21, 22. The load-bearing element 20 composed of rake arms in the manner of a frame is moved by the drive assembly through a repeatable path including an upward path portion along bar screen 6 and a downward path portion moves away from bar screen 6. During such path the lowest rake member 21 adopts successively the positions a, b and c. The lowest rake member 21 in so doing conveys the screenings 10 deposited on the bar screen 6 up to top-most position 21*a* of the rake member 21 with the conveyed screenings being at an intermediate position 11. The load-bearing element 20 and the rake members 21, 22 then is moved outwardly, downwardly and again inwardly and then upwardly to convey the next portion of screenings in the same manner to the same position. While the bottom-most rake member 21 is executing such sequence of movements, the second rake member 22 from the bottom simultaneously moves the screenings deposited by the bottom-most rake member 21 is executing such sequence of movements, the second rake member 22 from the bottom simultaneously moves the screenings deposited by the bottom-most rake member 21 from position 11 and conducts them upwards to the discharge position. Second rake member 22 also is moved through paths similar to those of bottom-most rake member 21, since both are fastened rigidly to the load-bearing element 20 and are guided by its sequence of movements. The entire conveying path 24 of the screenings thus is divided into two sections. The spacing 23 between the rake members 21, 22 must be smaller than the path of movement of each rake member in order to achieve the desired transfer.

Figure 2:
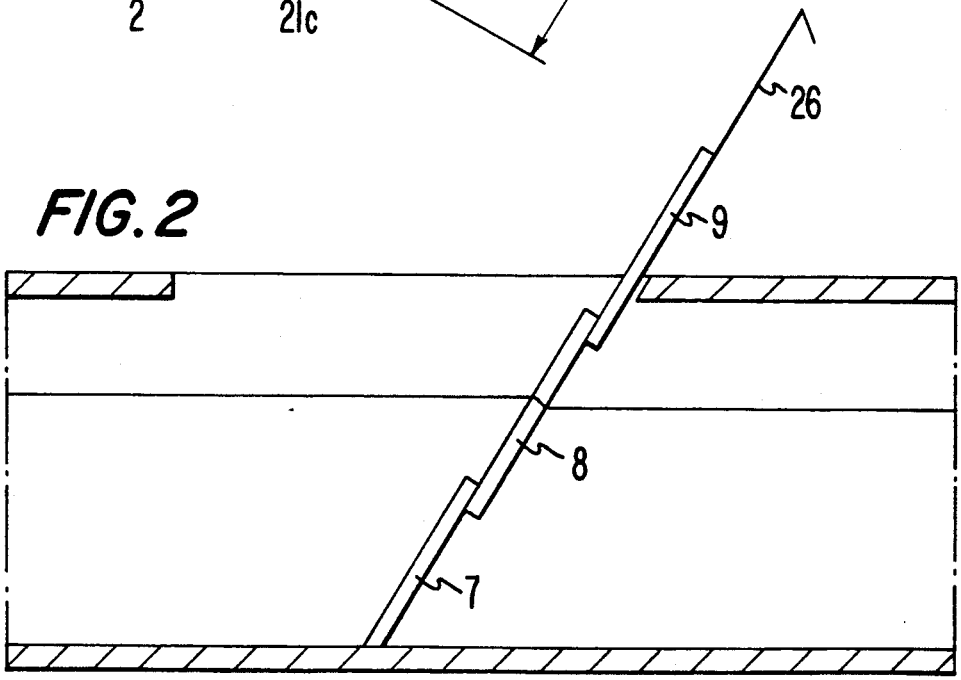
FIG. 2 is a diagrammatic longitudinal section through a stepped arrangement of bar screen and apron screen.

In the exemplifying embodiment shown in FIG. 2, the path of movement of the bottom-most rake part 21 is such that is projects in its upper end position above the water level 4, so that the position 11 of the screenings likewise lies above the water level 4. In other installation conditions the position 11 can lie below the water level 4. Depending on the nature of the screenings and the screen bars, the screenings can then remain at the position 11 until they are grasped by the second rake part from the bottom 22. The length of immersion of the bar screen is indicated as 25.

The embodiment shown in FIG. 2 is a stepped arrangement of three bar screen portions 7, 8, 9 that overlap at adjacent end sections and adjoined by a plane apron screen 26. The design of the load-bearing element and the rake members is similar to design according to FIG. 1. In this case the entire conveying length of the screenings is sub-divided into four individual sections, and four correspondingly designed rake members therefore have to be provided on a common load-bearing element. The conveyed screenings are deposited on a step by each of these rake parts at the end of their respective conveying paths and are collected by the following rake member and conveyed thereby to the next step.

Figure 3:
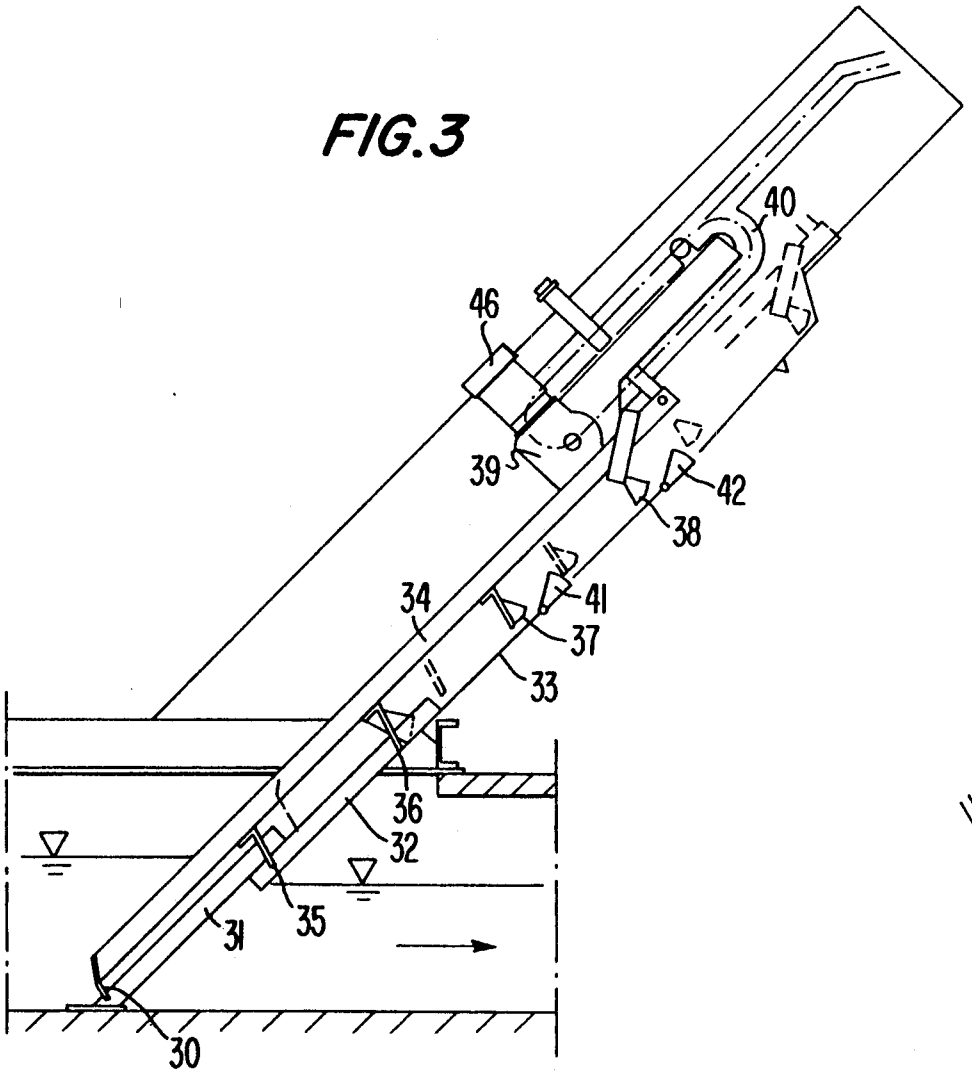
FIG. 3 is a diagrammatic longitudinal section through a conveying device with rakeable support elements.

FIG. 3 shows a bar screen composed of two bar screen portions 31, 32 of stepped arrangement which is adjoined by a plane apron screen 33. Rake members 30, 35, 36 designed as fingers are provided on rake arms 34 for engagement with the bar screen parts 31, 32, while rake members 37, 38 having linear edges are used for the conveyance of the screenings on the plane apron screen 33. Rake members 37, 38 also are fastened rigidly to the rake arms 34.

The drive motion of the rake arms 34 and the rake members 30, 35–38 connected therewith is carried out by a drive member 39 which travels in an enclosed loop-shaped track 40. The drive member 39 is driven by an electric: motor 46 and thereby moves along the enclosed track 40. Track 40 includes two linear track sections running parallel to the bar screen and apron screen and semi-circular-shaped track sections connecting adjacent ends of the linear &.rack sections. The rake arms 34 with the rake members 30, 35–58 are thereby moved linearly upwards until they reach the ends of their individual linear conveying paths, then are lifted away from the surfaces of the bar screen or apron screen, then are returned in a linear downward movement, and then are lowered again onto initial positions in engagement with the bar screen or the apron screen for the next conveyance cycle within the individual conveying paths.

Figure 4:
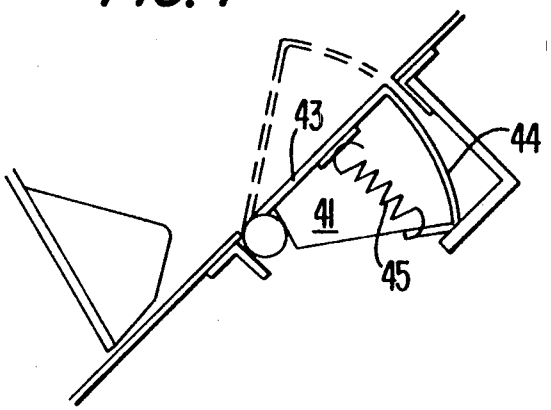
FIG. 4 is an enlarged view of a portion of the structure of FIG. 3.

Rakeable or movable support elements 41, 43 are provided in the region of the ends of the conveying paths of the rake members 37, 38. These each include, as can be seen in the detailed view of FIG. 4, a linear portion 43 having attached thereto a circular segment portion 44. Each element 41, 42 is urged a into phantom-line position by tension sprinqs 45. Each element is swingable to a solid-line position by movement thereover of a rake member. When in the phantom-line position the portion 44 forms a support or abutment preventing a downward sliding of already conveyed screenings.

The remaining parts of the channel and the sewage flow not shown in detail in FIG. 3 correspond to those according to FIG. 1.

I claim:

1. In an assembly including an inclined bar screen, and an apparatus for removing debris from said bar screen, the improvement wherein said apparatus comprises:

a plurality of rake members connected together, adjacent said rake members being spaced from each other in a direction parallel to said bar screen by a spacing less than the full length of said bar screen in such direction; and means for cyclically moving said rake members together as a unit both in a conveying direction along said bar screen over a distance less than said full length thereof and in directions toward and away from said bar screen, such that each said rake member is movable in said conveying direction along a respective different portion of said full length of said bar screen, and such that debris collected on said bar screen is conveyed in said conveying direction sequentially in stages by said rake members.

2. The improvement claimed in claim 1, wherein said plurality of rake members comprise at least three rake members spaced equally in said direction parallel to said bar screen.

3. The improvement claimed in claim 1, wherein said spacing between adjacent said rake members is less than said distance of movement in said conveying direction.

4. The improvement claimed in claim 1, wherein said spacing between adjacent said rake members is equal to 15 to 45% of a total of summed distances of movement of all of said rake members in said conveying direction.

5. The improvement claimed in claim 1, wherein said rake members are connected by at least one rake arm.

6. The improvement claimed in claim 5, wherein said moving means comprises an endless guide track including a linear track section extending parallel to said conveying direction, a return track section spaced from said linear track section, a first end track section connecting a first end of said return track section to an adjacent first end of said linear track section, and a second end track section connecting a second end of said linear track section to an adjacent second end of said return track section.

7. The improvement claimed in claim 6, wherein said moving means further comprises means for conveying said rake members and said at least one rake arm through a repeated cycle guided by said endless guide track from said first end of said linear track section to said second end thereof, during which said rake members are moved in said conveying direction, then along said second end track section from said second end of said linear track section to said second end of said return track section, during which said rake members are moved away from said bar screen, then along said return track section from said second end thereof to said first end thereof, and then along said first end track section from said first end of said return track section to said first end of said linear track section, during which said rake members are moved toward said bar screen.

8. The improvement claims in claim 1, wherein said bar screen is inclined to the vertical by an angle of from 10° to 50°.

9. The improvement claimed in claim 8, wherein said angle is from 15° to 30°.

10. The improvement claimed in claim 1, further comprising an apron screen extending from an upper end of said bar screen.

11. The improvement claimed in claim 1, further comprising means for retaining debris, conveyed by at least one said rake member to a position on said bar screen, at said position without falling downwardly therefrom upon movement of said at least one rake member away from said bar screen.

12. The improvement claimed in claim 11, wherein said retaining means comprises a step formed between adjacent offset screen portions.

13. The improvement claimed in claim 11, wherein said bar screen comprises adjacent sections offset from each other, and thereby defining a step between each adjacent pair of sections, said retaining means comprising said step dimensioned to collect debris moved thereto by said at least one rake member.

14. The improvement claimed in claim 11, wherein said retaining means comprises a support element pivotally mounted with respect to said bar screen, spring means urging said support element to a position in the conveying path of said at least one rake member, such that debris thereabove will be prevented thereby from falling downwardly.

15. The improvement claimed in claim 14, wherein said support element is pivotable against the force of said spring means to a position out of said conveying path by movement therealong of said at least one rake member.

16. The improvement claimed in claim 14, wherein said support element comprises fingers positioned between bars of said bar spring.

17. The improvement claimed in claim 14, wherein said support element comprises a radial member having connected to an outer end thereof a curved member defining a stop surface for retaining debris.

* * * * *